US005799455A

United States Patent [19]

Gates et al.

[11] Patent Number: 5,799,455

[45] Date of Patent: Sep. 1, 1998

[54] COLLAPSIBLE CORRUGATED PAPER FORM VOID

[75] Inventors: Robert C. Gates, Lakewood; Michael L. Turner, Englewood, both of Colo.

[73] Assignee: Surevoid Products, Inc., Englewood, Colo.

[21] Appl. No.: 723,477

[22] Filed: Oct. 9, 1996

[51] Int. Cl.[6] ..... E04B 5/00

[52] U.S. Cl. ..... 52/323; 52/576; 428/182

[58] Field of Search ..... 52/323, 576, 577, 52/745.09, 745.12; 249/10; 428/182

[56] References Cited

U.S. PATENT DOCUMENTS 3,834,103 9/1974 Knohl ..... 57/576 X 5,498,451 3/1996 Lafond ..... 428/182 X

*Primary Examiner*—Creighton Smith

*Attorney, Agent, or Firm*—Richard W. Hanes

[57] ABSTRACT

A form void for providing a space between a poured concrete structure and an underlying expansive soil is formed of three sheets of corrugated paper for shipping in a flat "knock-down" configuration and is erected at the construction site simply by inserting one panel into a groove between two other panels. The upper surface is comprised of three panel thicknesses, and the outer support panels are reinforced by a pair of internal support panels. The cross-sectional shape may be trapezoidal, rectangular, symmetric or non-symmetric, or have a sloped top.

22 Claims, 10 Drawing Sheets

COLLAPSIBLE CORRUGATED PAPER FORM VOID

BACKGROUND OF THE INVENTION

This invention relates generally to the construction of concrete walls, slabs or other structures adjacent to or inclusive of spaces. More particularly, this invention pertains to void forms for creating spaces beneath concrete structures to separate and protect the structures from underlying expansive soils.

Expansive soils are prevalent in many areas of the United States, as well as in other countries. Such soils typically contain much clay, and expand and contract considerably as a result of cyclical changes in moisture content and/or as a result of natural freezing-thawing cycles.

A common method of construction in such expansive soils uses spaced drilled piers or spread footings for supporting the walls and floors. In this method, the concrete walls or beams supported by the piers or footings must be provided with a substantial spacing from the expansive underlying soil. Otherwise, the upward expansion of the soil may engage and force the beams or walls upward, causing cracking and deformation of the concrete. Without sufficient spacing between the concrete and the underlying soil, the integrity of the concrete structure is eventually lost.

Excavation of soil from beneath a concrete structure after it has "set" is a labor-intensive, very expensive method for resolving the problem with expansive soils. Where the structure has a lower edge below grade, a trench sufficiently wide to permit hand removal of soil below the structure must be provided. Furthermore, it is desirable to remove any forms of wood, metal or plastic used to form the lower surface of the structure. Such forms have a long life and should be removed after the concrete has set to provide further expansion space below the structure, and for re-use.

The use of corrugated paper void forms is known. For example, such void forms are placed at the bottom of wall forms and trenches between piers to substantially separate the subsequently poured concrete from the underlying ground.

The corrugated paper void forms have sufficient temporary strength to support the wet concrete at a distance above the ground, but gradually absorb moisture and deteriorate to a condition where they no longer provide support. However, by this time the concrete has set and needs no support other than that provided by the piers. During periods of upward expansion of the underlying soil, the soil occupies the space left by the deteriorated or weakened void forms.

Void forms are available in various cross-sectional configurations. The generally rigid void forms are prepared by forming the desired structural shape of panels of corrugated paper and joining the panels together with adhesive. An internal cellular grid structure may be used within the void forms to increase the strength of the void forms as required. The exterior surfaces of the paper void forms are typically treated with wax to provide temporary water resistance and thus an appropriate time delay in deterioration.

Shipping charges are a major cost of using such void forms. Existing paper void forms are lightweight, their cross-sections being typically about 70–90 percent space. Thus, the quantity of paper void forms which may be fitted into a truck is severely limited, and the weight of the truckload is only a small fraction of the available weight limit for the truck.

It is a goal of the invention to provide a void form which may be shipped at a much greater density to reduce shipping costs.

It is a further object to provide a void form which may be shipped in a space-saving "knocked-down" condition to a job site where the void form is quickly and easily assembled in minimum time.

In addition, an object of the invention is to provide a void form which requires no on-site application of adhesive.

BRIEF SUMMARY OF THE INVENTION

An improved void form of rectangular or trapezoidal cross-section is formed from corrugated paper and has a structure permitting essentially complete unfolding and collapse to a generally flat sheet with smaller panels of corrugated paper on its face and reverse surfaces.

The paper from which the void form is manufactured is like that from which paper cartons are typically formed, i.e. a corrugated paper structure sandwiched and cemented between two sheets of thin cardboard. The maximum bending strength of the corrugated paper lies in the direction of the corrugation ridges, hence a corrugation ridge direction is maintained perpendicular to the direction in which the paper is most susceptable to form bend lines under the applied forces, thus increasing the weight of wet concrete which may be supported.

The void form is assembled and disassembled easily by hand, and does not need on-site adhesive application. In the disassembled or collapsed configuration, the void form may be stacked or bundled to enable shipment it a much higher density. The shipping costs are substantially reduced.

These and other objects and advantages of the invention will be readily understood by perusal of the following description in conjunction with study of the accompanying figures of the drawings wherein like reference numerals have been applied to designate like elements throughout the several views.

DESCRIPTION OF THE PREFERRED EMBODIMENTS

Figure 1:
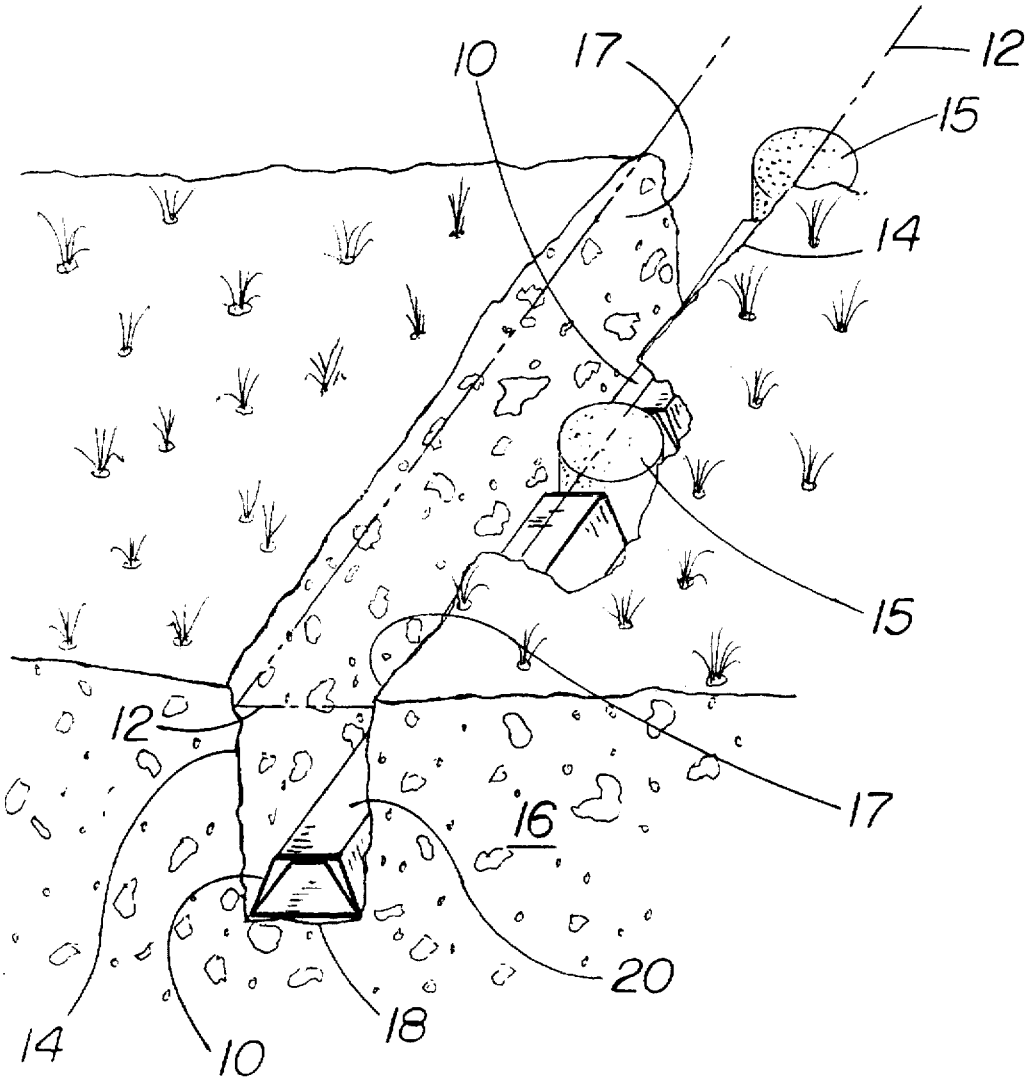
FIG. 1 is a perspective partial end view of a void form of the invention in a trench for forming a concrete wall supported on piers.

With reference to the drawings, and particularly to FIG. 1, an exemplary collapsible trapezoidal corrugated paper void form 10 is shown as used to construct a vertical concrete wall 12. In this exemplary use, the void form 10 is placed in a trench bottom 18 in the ground 16 between previously poured and hardened drilled piers 15 which will support the hardened concrete wall 12. Wet concrete is poured into the trench 14 atop the void form 10 and the trench walls 17 act as forms to confine the wet concrete. The void form 10 creates a space or void between the wall 12 and the ground 16 beneath the wall 12. The underlying void forms 10 have sufficient strength to support the wet concrete poured atop the void forms 10.

Figure 1A:
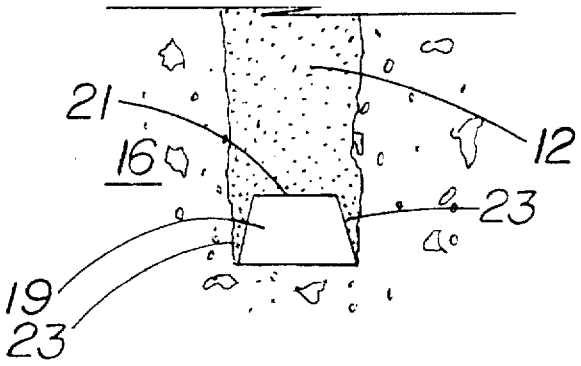
FIG. 1A is a partial cross-sectional end view of a concrete wall overlying a void formed by a void form of the invention.

After the concrete sets, the void forms 10 are no longer required to support the wall, and absorption of soil moisture by the corrugated paper leads to weakening, deterioration and eventual disintegration of the paper void forms. The hardened wall 12 is then fully supported by the piers 15. The bottom 21 of the hardened wall 12 is shown in cross-section in FIG. 1A with a void 19 below the central portion of the bottom, between the thinned lateral concrete sections 23. Expansive soils 16 expand into the void 19, and the concrete sections 23 tend to break away from the wall 12 under high stresses, e.g. large rocks pushed upwardly. Thus, the integrity of wall 12 is maintained.

We turn now to FIGS. 2 through 11, which illustrate two trapezoidally shaped embodiments of the invention in detail. The primary difference between the two embodiments relates to the construction of the multi-layer top panel indicated as 20 in FIG. 1.

Figure 2:
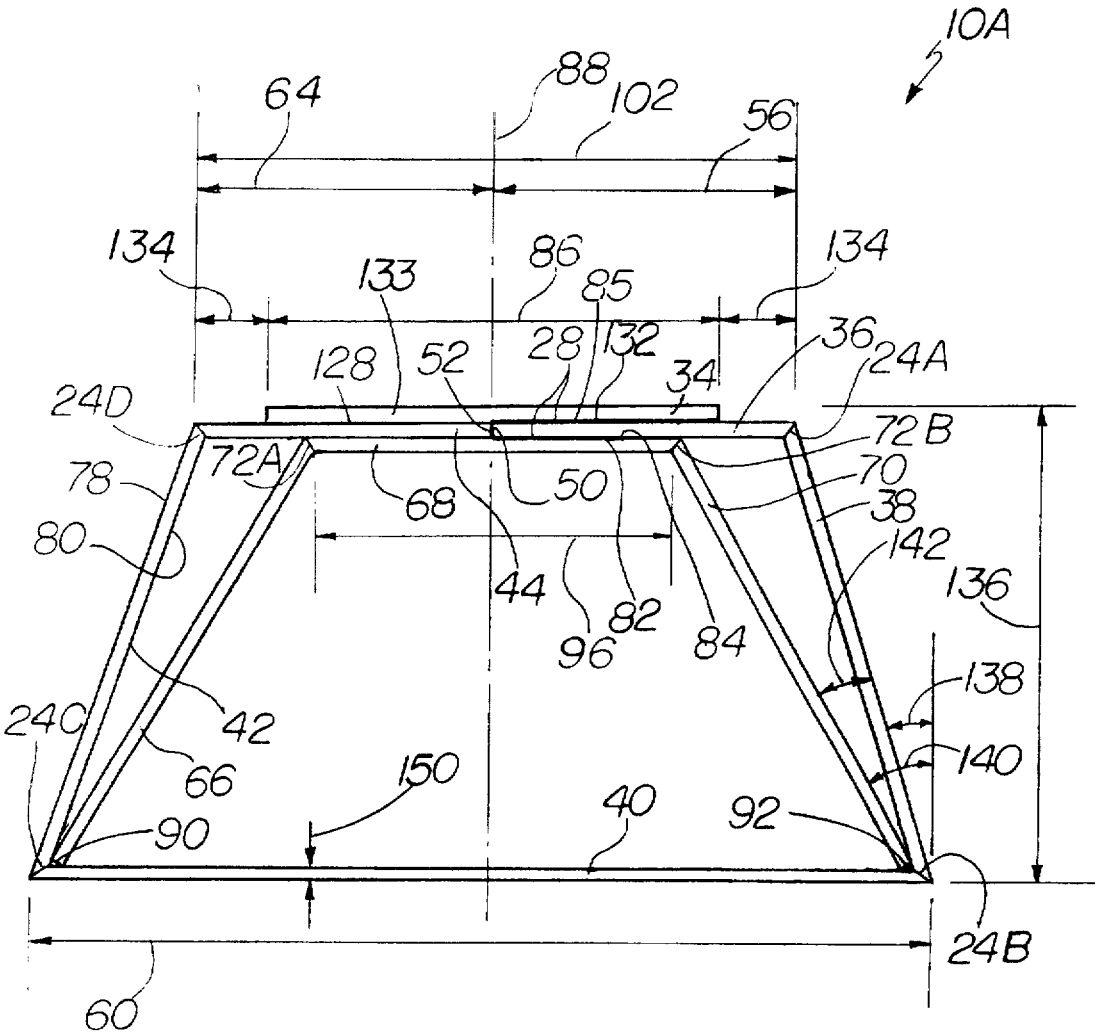
FIG. 2 is an end view of an assembled trapezoidal void form of the invention with exaggerated panel thicknesses.
Figure 3:
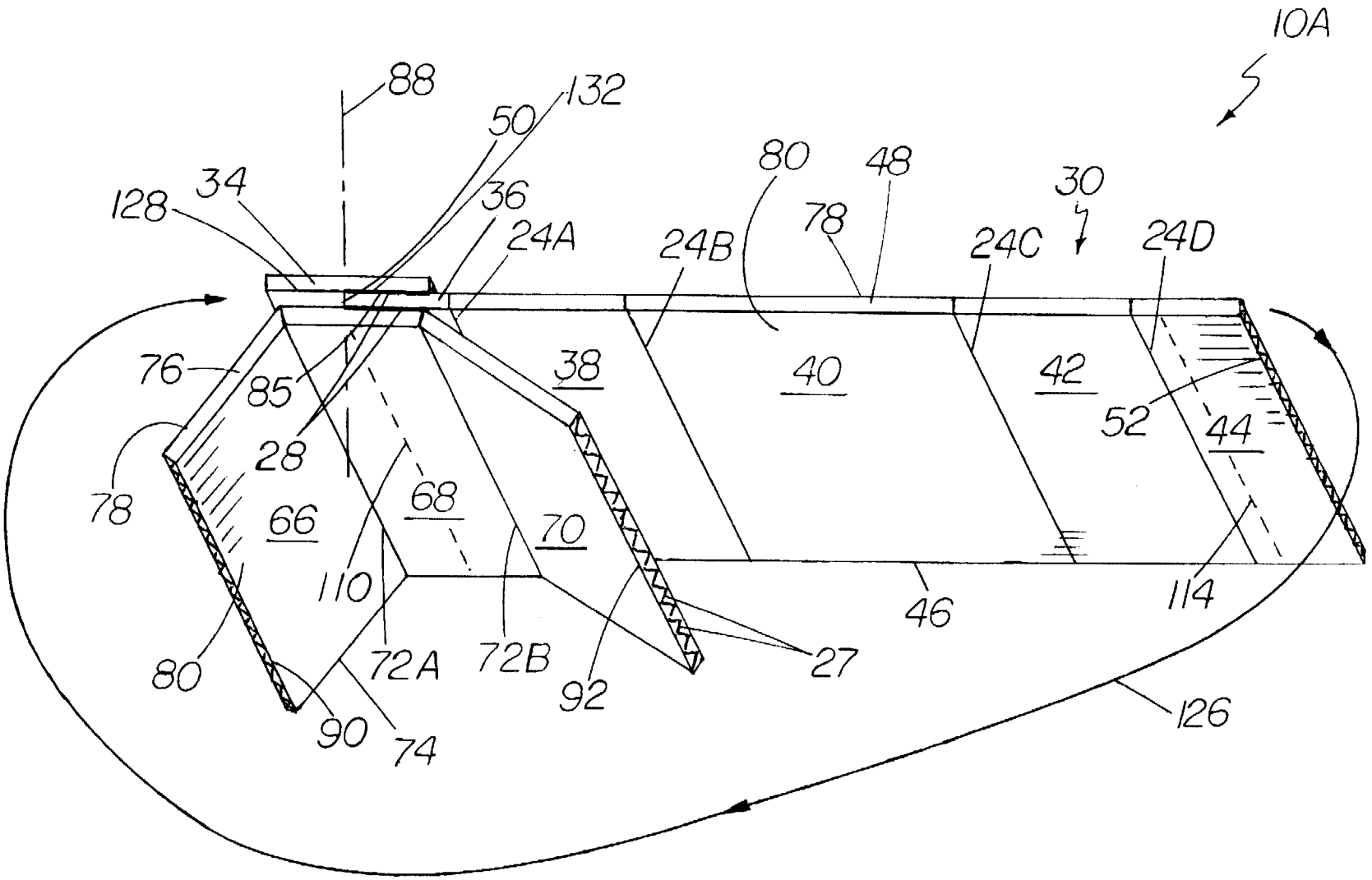
FIG. 3 is a perspective bottom view of an unassembled void form of the invention with exaggerated panel thicknesses.
Figure 4:
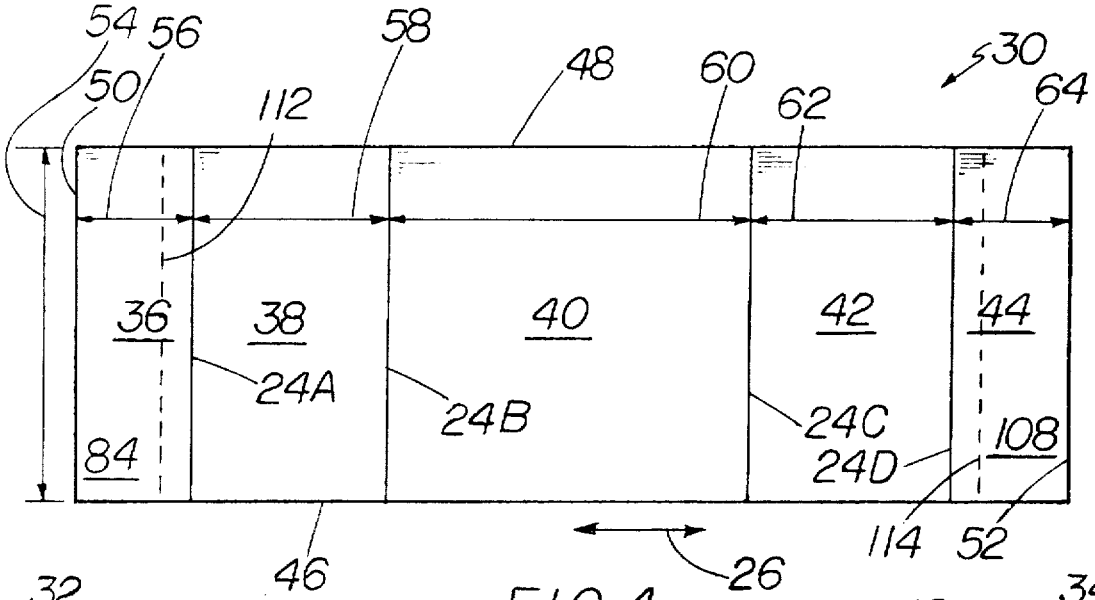
FIG. 4 is a plan view of a first component of a void form of the invention.
Figure 5:
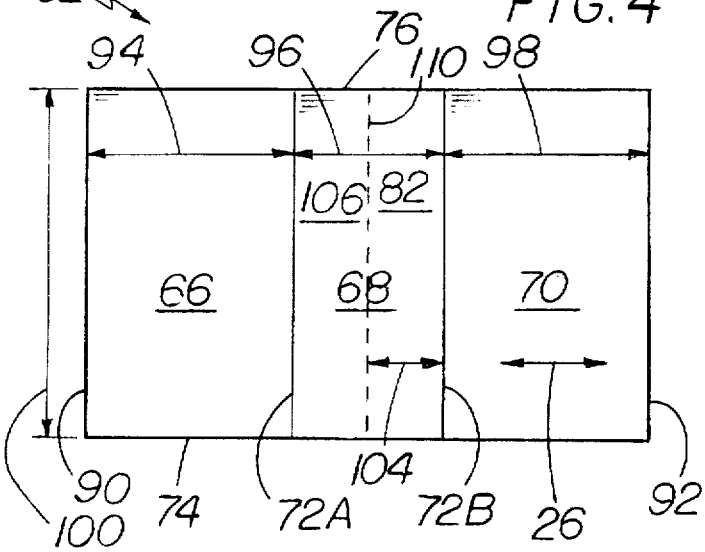
FIG. 5 is a plan view of a second component of a void form of the invention.
Figure 6:
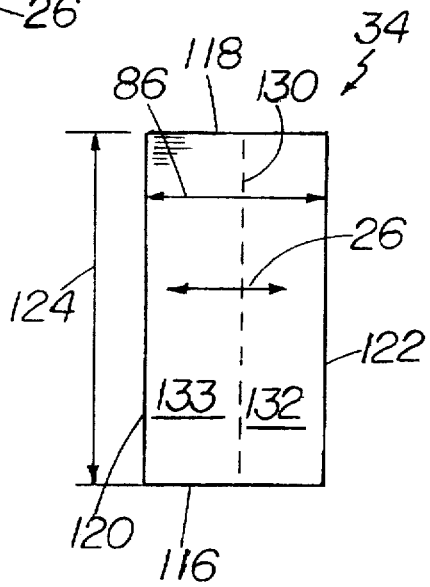
FIG. 6 is a plan view of a third component of a void form of the invention.
Figure 7:
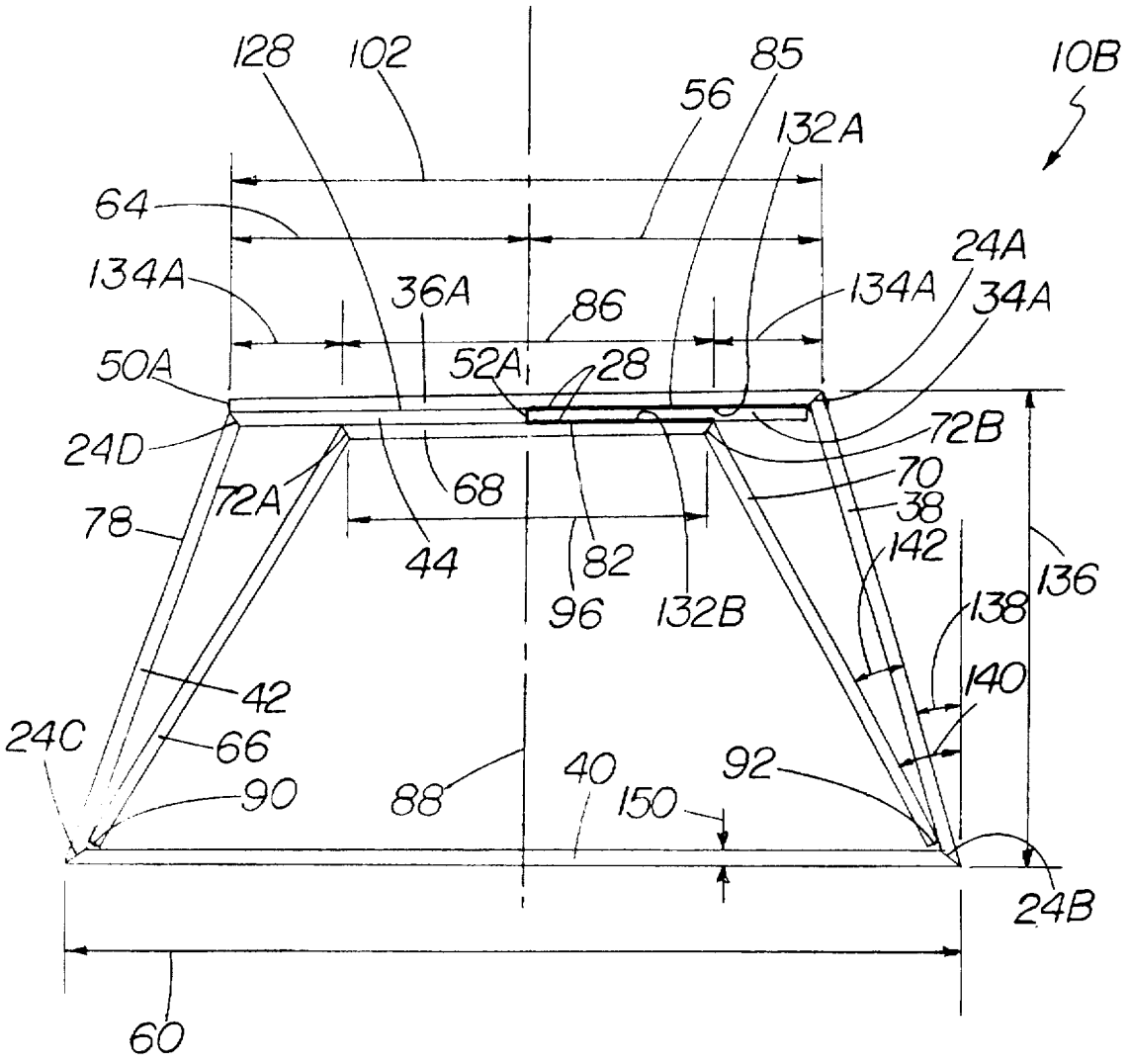
FIG. 7 is an end view of a further embodiment of a trapezoidal void form of the invention, with generally exaggerated panel thicknesses.
Figure 8:
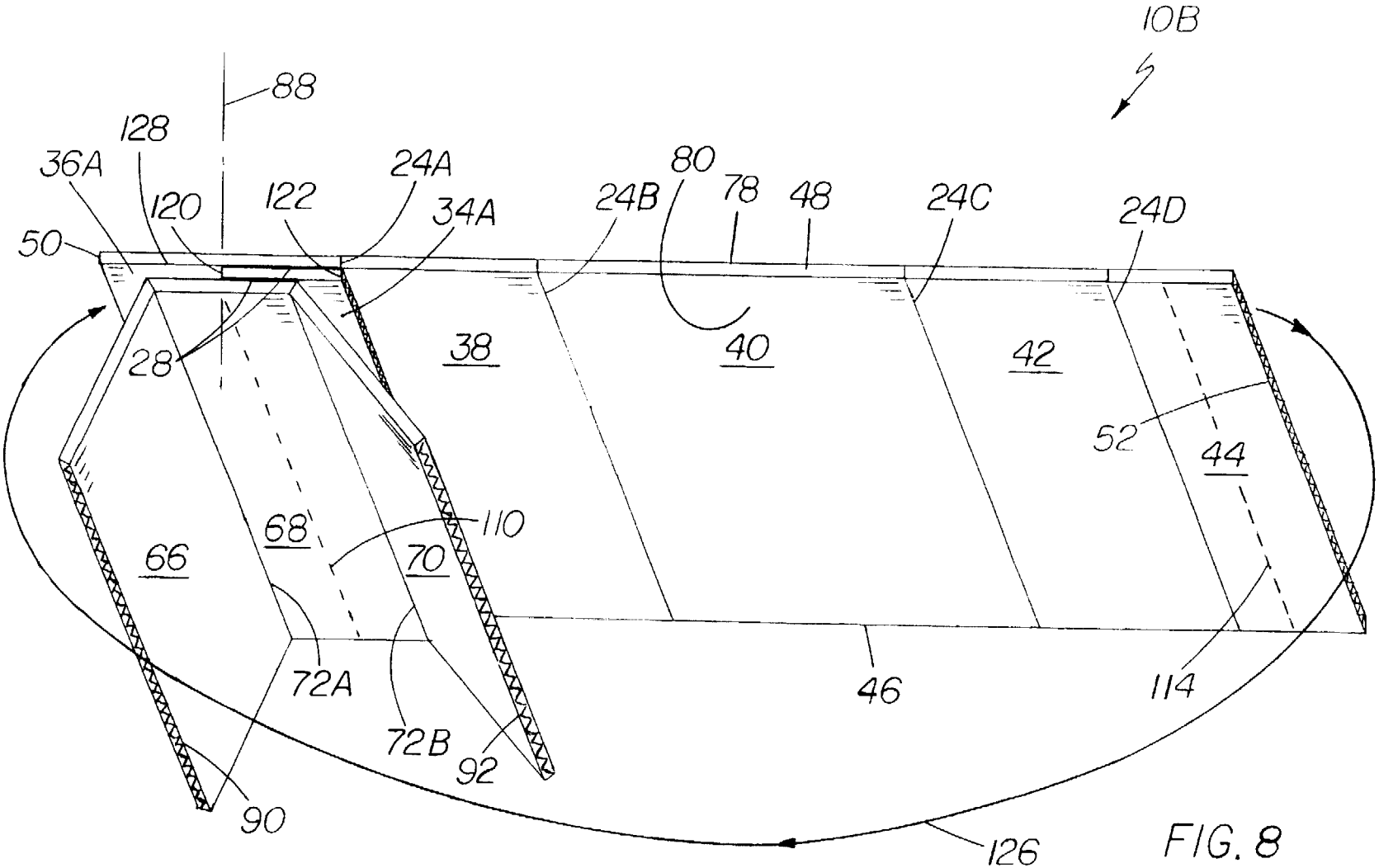
FIG. 8 is a perspective bottom view of a further embodiment of an unassembled void form of the invention, with exaggerated panel thickness.
Figure 9:
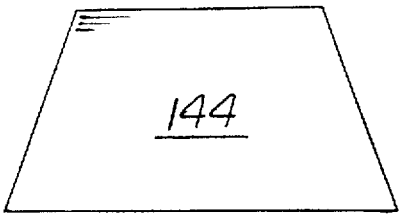
FIG. 9 is a plan view of an end cap for a void form of the invention.
Figure 10:
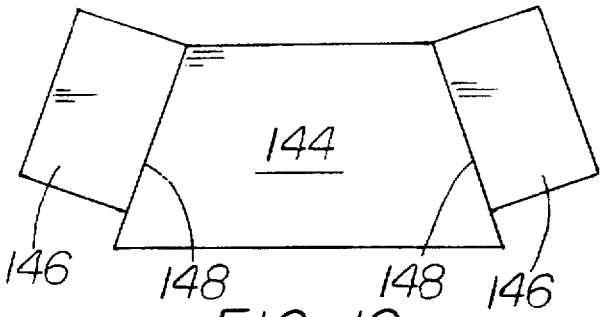
FIG. 10 is a plan view of another embodiment of an end cap for a void form of the invention.

The cross-sectional end views of FIGS. 2 and 7 show the assembled void form 10A, 10B. FIGS. 3 and 8 show the two embodiments 10A, 10B of void form 10 in a pre-assembled or knocked-down state, and FIGS. 4–6 show the three components, i.e. three planar sheets 30, 32 and 34 of corrugated paper, which are joined by adhesive 28 over limited surface areas to fabricate the unassembled void form 10.

Each void form 10 comprises a plurality of generally planar panels formed from three generally rectangular sheets 30, 32 and 34 of corrugated paper. A primary sheet 30 of corrugated paper is divided into first panel 36, second panel 38, third panel 40, fourth panel 42 and fifth panel 44, each panel defined by parallel fold lines 24A, 24B, 24C, and 24D extending the length 54 of the primary sheet. These straight fold lines 24A, 24B, 24C, and 24C are parallel to opposing free edges 50, 52 and preferably perpendicular to the direction 26 of corrugation ridges 27. The fold lines extend from end 46 to end 48 of the primary sheet 30. Thus, each of panels 36, 38, 40, 42, and 44 is generally rectangular and generally has the same length 54. First panel 36 and fifth panel 44 comprise terminal panels of sheet 30 which extend to first and second free edges 50, 52, respectively.

In this discussion, the term "length" refers to the dimension corresponding to the long dimension of the assembled void form 10. Likewise, the term "width" refers to a dimension of a panel or sheet perpendicular to both the length and thickness of a panel or sheet of the assembled void form 10.

In the assembled configuration of FIG. 2, first panel 36 and fifth panel 44 comprise a portion of the top of the void form 10, wherein first free edge 50 of panel 36 end second free edge 52 of panel 44 are abutted. Second panel 38 and fourth panel 42 comprise opposed lateral members of the assembled void form 10, and centrally located third panel 40 comprises a lower portion or base of the void form. The width 56 of panel 36 and width 64 of panel 44 together comprise the overall width 102 of the top of the void form 10. This particular embodiment 10A of the void form 10 is shown as having a cross-section which is generally symmetrical about a central vertical plane 88 bisecting the void form 10 lengthwise. Each panel in the void form 10 has a face side 78 and a reverse side 80.

As shown in FIG. 4, the primary sheet 30 includes terminal panels 36 and 44 with widths 56 and 64, respectively, side panels 38 and 42 with widths 58 and 62, respectively, and bottom panel 40 with width 60. To construct the symmetrical embodiment 10A of void form 10 shown in FIG. 2, widths 58 and 62 are identical, and widths 56 and 64 are also identical.

A secondary rectangular sheet 32 is shown in FIG. 5 as having three planar panels designated herein as left panel 66, center panel 68, and right panel 70. These, panels are separated by parallel straight fold lines 72A and 72B. The fold lines 72A and 72B are generally perpendicular to the corrugation ridge direction 26 and ends 74, 76, and parallel to opposite sides 90 and 92. Panels 66, 68 and 70 are shown as having widths 94, 96 and 98, respectively, and have a length 100 which is generally the same as length 54 of the first sheet 30. Panels 66 and 70 comprise internal angular supports extending angularly from the first and fifth panels 36, 44 to the opposing fold lines 24C and 24B, respectively of third panel 40, i.e. the lower portion or base of the void form 10. For a void form 10 symmetrical about the central vertical plane 88, the widths 94 and 98 of panels 66 and 70 are substantially the same.

A rectangular portion 82 of the second panel 68 of the secondary sheet 32 extends from end 74 to end 76 and is cemented by an adhesive 28 to a rectangular face portion 84 extending between ends 46 and 48 of the first panel 36 of the primary sheet 30, as shown by comparing FIGS. 2, 3, 4 and 5. The portion 82 is shown as extending between fold line 72B and adhesive limit line 110. The portion 84 is shown as extending between first side 50 and adhesive limit line 112 of panel 36, i.e. it is a terminal adhesive portion on the reverse surface 80 of panel 36. For a symmetrical void form 10A, the rectangular portion 82 preferably comprises about one half of panel 68, i.e. a portion having the width 104 as shown. Alternatively, portion 82 may comprise either more or less than one half of panel 68. In any case, the remaining portion 106 of panel 68 does not contact panel 36 but projects parallel to, and away from panel 36. When the void form 10A is assembled, portion 106 is in contact with portion 108 of panel 44. The portion 108 extends from second free edge 52 to insertion line 114, and abuts the first free edge 50 of panel 36.

As depicted in FIG. 6, a planar tertiary rectangular sheet 34 of corrugated paper having width 86 is formed without fold lines. A portion 132 of one surface is designated an adhesive portion for cementation to the second terminal adhesive portion 85 (see FIG. 2) on the face surface 78 of panel 36. The direction 26 of corrugation ridges 27 is as shown. Sheet 34 comprises a top panel and may have a width 86 varying from about equal to width 96 of panel 68 to greater than width 102. Preferably, width 86 is greater than width 96 and may approach or equal width 102. Tertiary sheet 34 has opposed ends 116 and 118, and opposed edges 120 and 122. The length 124 of edges 120 and 122 is generally the same as lengths 54 and 100 of the first and second sheets 30 and 32, respectively. A portion 126, typically one half of the primary surface 78 or secondary surface 80 of sheet 34 is cemented by adhesive 28 to the face surface 78 of first panel 36 (compare FIGS. 2, 3 and 6). Adhesive portion 132 of sheet 34 is bounded by second side 122 and adhesive limit line 130. The adhesive limit line 130 typically bisects the tertiary sheet 34. The adhesive portion 132 of sheet 34 is joined by adhesive to portion 85 of panel 36 and the remaining portion 133 projects from panel 36 parallel to and spaced from portion 106 of panel 68.

The adhesive 28 may be fully spread over the mating adhesed surfaces, or may be partially spread or comprise a particular pattern, as desired.

Like embodiment 10A, the embodiment 10B of FIGS. 7 and 8 uses three similar sheets 30, 32 and 34 of FIGS. 4–6, although the widths 56, 64, and 86 of panels 36, 44 and sheet 34, respectively, are typically different for the same overall size of void form. It is noted in particular that in the embodiment 10A of FIG. 2, the first and second edges 50, 52, of the primary sheet 30 are abutted in the completed void form 10A. On the other hand, panel 36A comprises the top 20 and overlies both panel 34A and panel 44 in the embodiment 10B of void form 10B when erected, as shown in FIG. 7. Thus, in embodiment 10A, the elongate groove 128 into which panel 44 is inserted lies between the tertiary sheet 34 and the second panel 68. The elongate groove 128 of embodiment 10B lies between the first panel 36A (which comprises the top 20 of the void form) and the second panel 68. To obtain a symmetrical void form 10B, the width 58 of panel 38 is greater than the width 62 of the fourth panel 42 by one panel thickness 150.

In the second embodiment 10B as shown in FIGS. 7 and 8, one surface 132A of tertiary sheet 34A is cemented to the underside 85 of panel 36A, and a portion of the opposing surface 132B is cemented to an adhesive portion 82 of second panel 68, generally on one side of central vertical plane 88. Thus, an elongate groove 128 is formed between panel 36A and 68, into which panel 44 is inserted in direction 126 to form the erected void form 10B.

Assembly of the void form 10A is simply performed as shown in FIG. 3 by folding the primary sheet 30 in the same direction at each fold line 24A, 24B, 24C and 24D, and scrolling the sheet 30 in direction 126 about the support panels 66 and 70. As scrolled, the face side 78 of the primary sheet 30 becomes the exposed exterior of the void form 10A, and the reverse side 80 becomes the interior. The second side 52 of fifth panel 44 is simply inserted into elongate space or groove 128 between panel 68 and sheet 34 to abut the first side 50 of first panel 36, where it is held by friction and by downward forces from the weight of wet concrete placed atop the tertiary sheet 34.

Void form 10B of FIGS. 7 and 8 is also simply assembled in a very similar manner, as illustrated in FIG. 8. The primary sheet 30 is folded at parallel fold lines 24A., 24B, 24C and 24D, and the sheet 30 is scrolled in direction 126 about the support panels 66, 70. As scrolled, the face side 78 of the primary sheet 30 becomes the exposed exterior of the void form 10B, and the reverse side 80 becomes the interior. The second side 52 of fifth panel 44 is simply inserted into elongate space or groove 128 between panel 36A and panel 68.

The orientation of the corrugation ridges 27 as shown in FIGS. 1–8, i.e. perpendicular to the foldlines, results in the highest resistance to crushing from a downwardly directed load such as wet concrete.

To increase the strength of the void form 10, an adhesive may be applied to the panel 44 and the surfaces of the panel retaining space or groove 128 so that panel 44 is cemented therein. This may be done at the construction site where the void form 10 is to be used. Generally however, job-site cementation is not needed, and is not generally recommended.

For the generally symmetrical void form 10A shown in FIG. 2, the central vertical plane 88 passes through the adhesion lines 110 and 130 of panel 68 and sheet 34, respectively.

For the generally symmetrical void form 10B of FIG. 7, the central vertical plane 88 passes through the adhesion line 110 of panel 68, and the center of panel 36.

It is to be noted that in reference to FIGS. 4–6, embodiment 10B generally requires a greater panel width 56 than that of embodiment 10A, typically by a factor of about two. In addition, the panel width 86 of embodiment 10A is greater than that of embodiment 10B, comprising the void form top 20 rather than merely underlying a portion thereof.

While this description indicates a particular orientation of the sheets 30, 32 and 34 relative to their face surfaces 78 and reverse surfaces 80, it is understood that these surfaces may be interchanged if desired. Corrugated paper may be used which has differing strengths on opposing face surfaces 78 and 80, and the overall strength of the void form 10 may be varied through reversal of the surfaces of one or more of the three sheets 30, 32 and 34.

The size of the void form 10 will vary, depending upon the dimensions of the concrete structure which is to be poured. Thus, for constructing a wall having a thickness of 6 inches (15.25 cm), the width 60 of sheet 40 will be about 6 inches, and the total width 102 of abutting panels 36 and 44 will be somewhat less.

As shown in FIGS. 2 and 7, the angle 138 of side panels 38 and 42 with the vertical is shown as between about 16 and 18 degrees. The preferred angle 138 is between about 0 and about 30 degrees to maximize the carrying capacity. Thus, void forms 10 may have vertical side panels 38, 42.

For embodiments 10A and 10B, the angle 140 of internal support panels 66 and 70 with the vertical is shown as about 28 degrees. The angle 140 is preferably less than about 45 degrees, and more preferably less than about 35 degrees. The angle 142 between internal support panels 66 and 70 and external support panels 42 and 38, respectively, is dependent upon the chosen location of bend lines 72A and 72B. It is desirable to locate the bend lines 72A and 72B to maximize the weight which the void form 10 will support, as determined by known methods of static and dynamic analysis.

The void form 10 has an overall height 136 which becomes the ultimate elevation of the lower edge of a major portion of the set concrete above the underlying ground 18.

The length 54, 100, 124 of the completed void form 10 may vary, but the preferred length is such that an even number of void forms will provide the desired distance between support piers 15. Building design in the construction arts results in a wide range of pier spacing. A void form length of 5 feet has been found in practice to be one of the most useful lengths, but other lengths may also be provided to accommodate the variations in structural designs. Of course, the void form 10 may be easily cut on-site to any desired length with a knife or saw. When void forms are placed end to end, the abutting ends may be sealed with a covering such as tape or a piece of paper to prevent the entrance of wet concrete. Likewise, the ends adjacent the piers or other structure may be sealed with end caps 144, as illustrated in FIGS. 9–12.

End caps 144 are known in the prior art for covering the open ends of void forms 10 to prevent entry of wet concrete. End caps 144 may be separately cut from corrugated paper sheets in the shape of the void form ends (see FIG. 9) and joined to the ends of the void form 10 with adhesive, or have tabs 146 (see FIG. 10) joined along fold lines 148. The tabs 146 slip into the void form 10 to retain the end cap 144 as an end cover of the void form. The use of adhesive is avoided. Such end caps 144 are particularly useful for sealing void forms 10 which are cut to length at the construction site.

Figure 11:
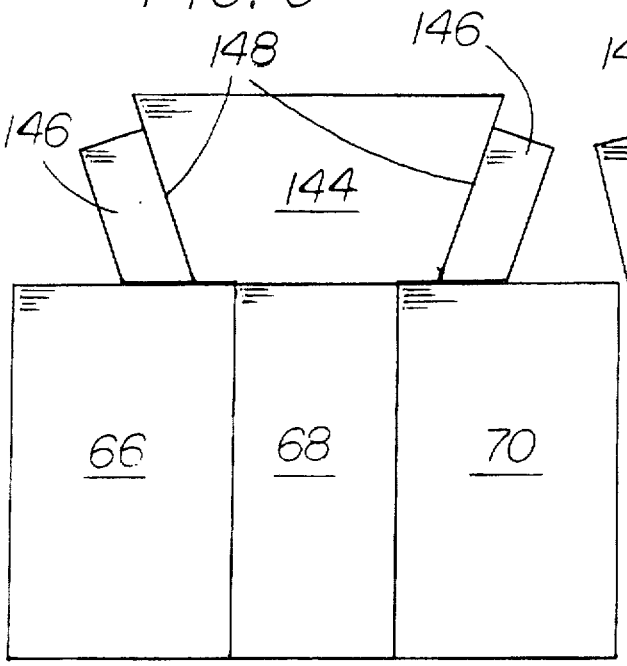
FIG. 11 is a plan view of a further embodiment of an end cap for a void form of the invention.
Figure 12:
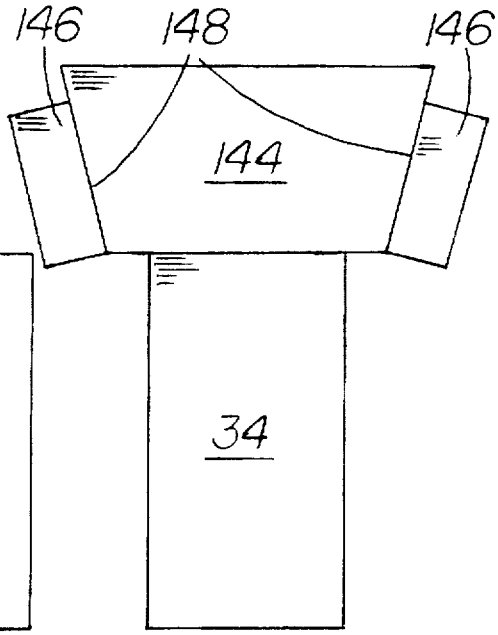
FIG. 12 is a plan view of another embodiment of an end cap for a void form of the invention.

In exemplary alternate configurations illustrated in FIGS. 11 and 12, the end caps 144 for embodiment 10A may be formed as part of the secondary sheet 32 or tertiary sheet 34 respectively. For embodiment 10B, the end caps may be formed as part of the primary sheet or tertiary sheet. Tabs 146 may be included to be folded along fold lines 148 and inserted into the void form 10 to retain the end cap 144 in place, thereby overcovering the end of the assembled void form 10. The end caps 144 may be formed on only one end, as illustrated in FIGS. 11 and 12, or on both ends of the particular sheet 30, 32, or 34.

To form a non-symmetrical void form 10, the widths 58 and 62 are configured to differ. Non-symmetrical void forms 10 may be useful where the bottom of the concrete wall is to have a non-horizontal surface. In such cases, the panel widths providing the desired void form structure may be computed by geometric principles.

Figure 13:
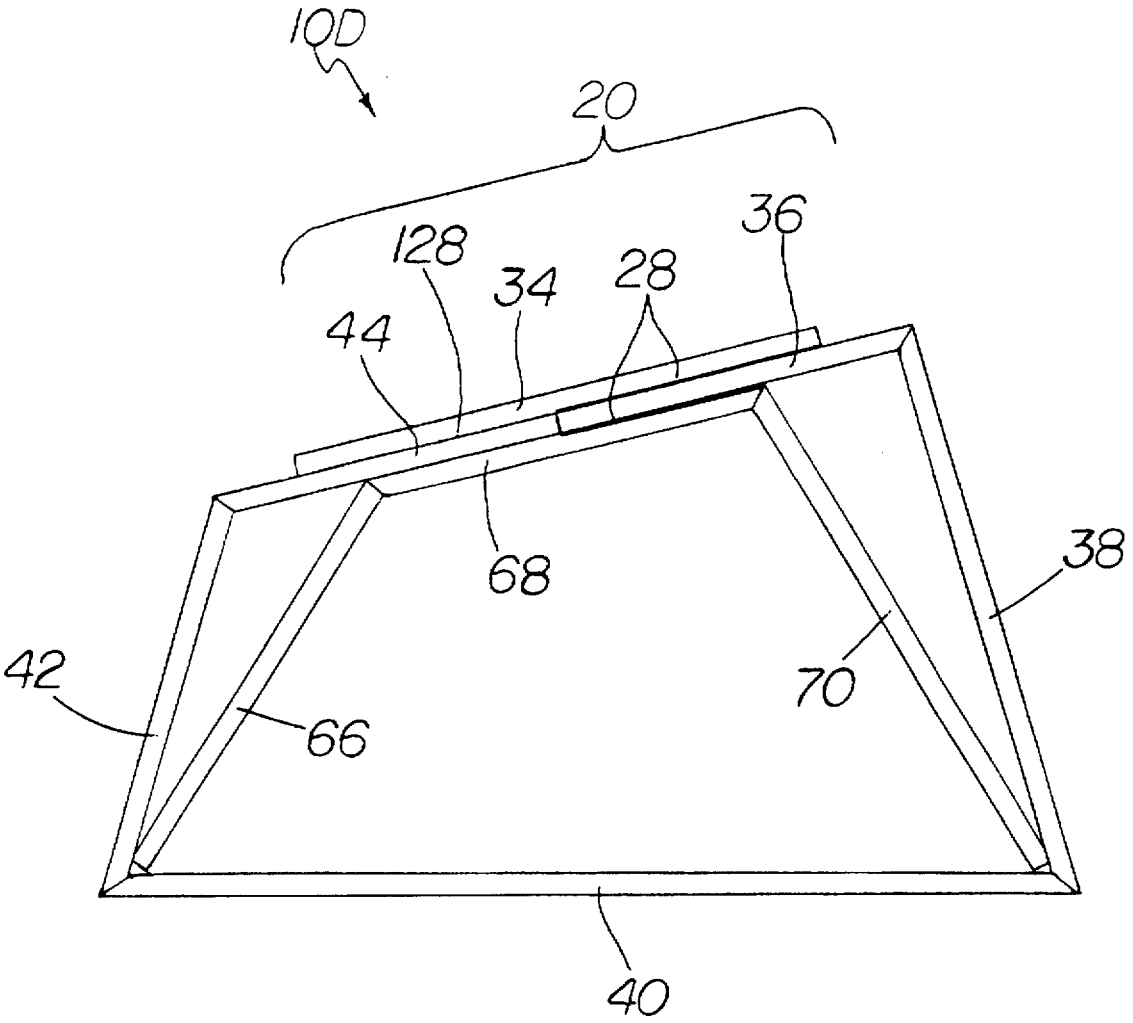
FIG. 13 is an end view of a further embodiment of an assembled void form of the invention, with generally exaggerated wall thickness.

FIG. 13 illustrates an exemplary cross-sectional configuration of a non-symmetrical void form 10 having a non-horizontal top 20. The use of such a void form 10 with non-horizontal top 20 results in a non-horizontal bottom edge of a concrete structure. In the non-symmetrical void form 10 designated as embodiment 10D in FIG. 13, the construction is basically like that of embodiment 10A except that widths of some of the panels are varied. Opposing panels 38 and 42 are unequal in width. Likewise, opposing panels 66 and 70 are unequal in width. The result is a non-symmetrical void form 10D with a sloping top 20 including parallel panels 34, 36, 44 and 68. If desired, the general construction of embodiment 10B, previously described, may be varied by changing panel widths to achieve a similar void form, not illustrated, with a sloping top 20.

As already indicated, the general cross-sectional shape of the void form 10 may be symmetrical or non-symmetrical, with side panels 38, 42 either vertical or non-vertical, and with parallel or non-parallel bottom i.e. third panel 40 and top 20.

Figure 14:
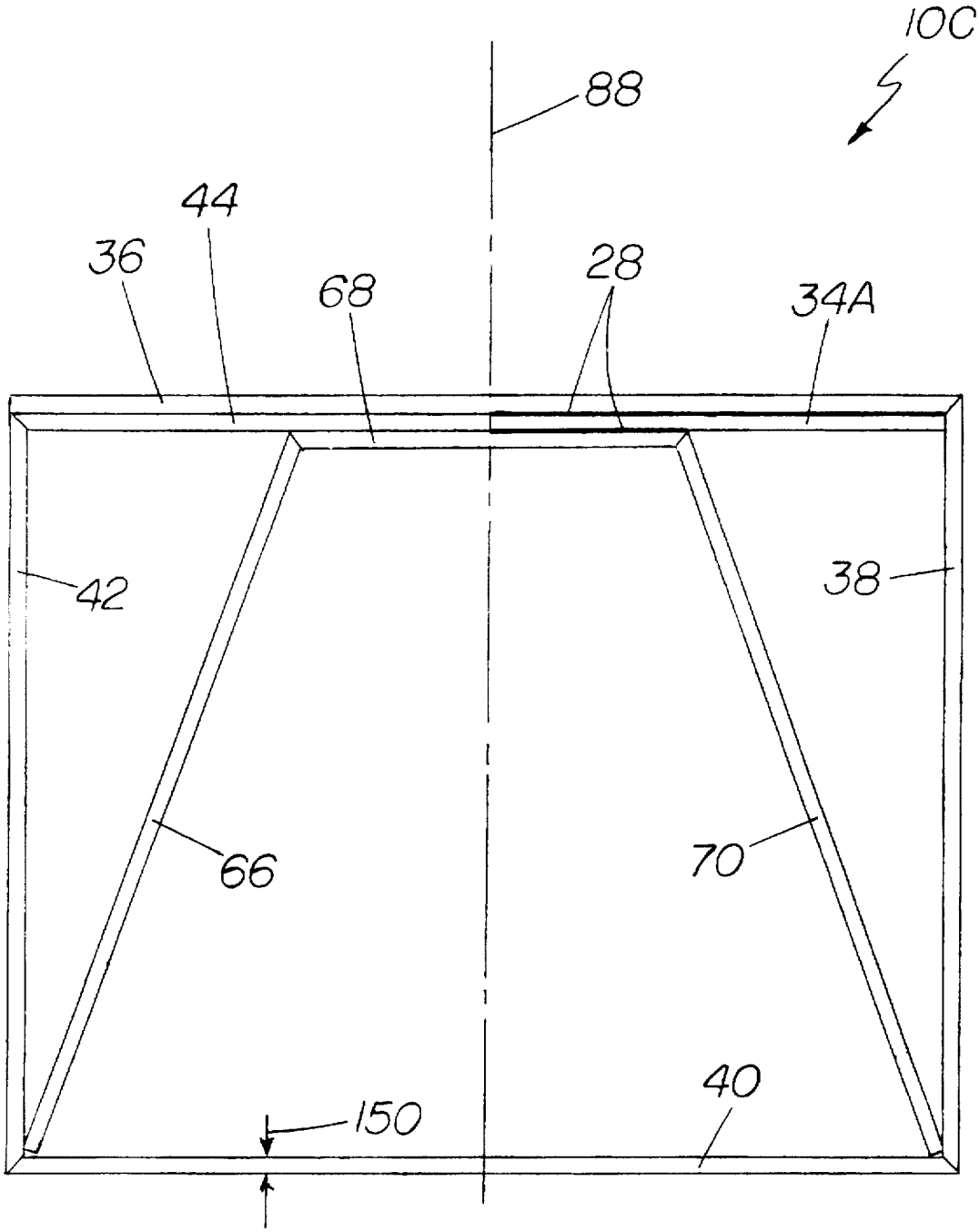
FIG. 14 is an end view of another embodiment of an assembled void form of the invention, with generally exaggerated wall thickness.

An example of a void form 10C with parallel vertical side panels 38 and 42 is shown in FIG. 14. The construction is the same as for embodiment 10B of FIGS. 7 and 8, by referring to FIGS. 4–6, except that the width 56 of panel 36 is made equal to the width 60 of panel 40, and the combined total of widths 86A and 64 of sheet 34A and panel 44, respectively, is made equal to width 60 minus one panel thickness 150. As in embodiment 10B, adhesive 28 is used to join tertiary sheet 34A to panel 36A and to second panel 68 of the secondary sheet 32.

There are numerous ways to vary the strength of the void form 10. First, a corrugated paper panel of different thickness or design strength may be used. Secondly, one or more panels may be formed or more than a single ply of corrugated paper, the panel(s) thus being formed by cementing the plies or layers of corrugated paper material together with an adhesive 28. Third, one or more interior support panels may be added to augment support panels 38, 42, 66 and 70. Fourth, as already mentioned, panel 44 may be cemented within groove 128 with adhesive 28 at the construction site. Fifth, an additional cellular structure of corrugated paper may be inserted within the void form 10 to enhance the strength of the void form.

Figure 15:
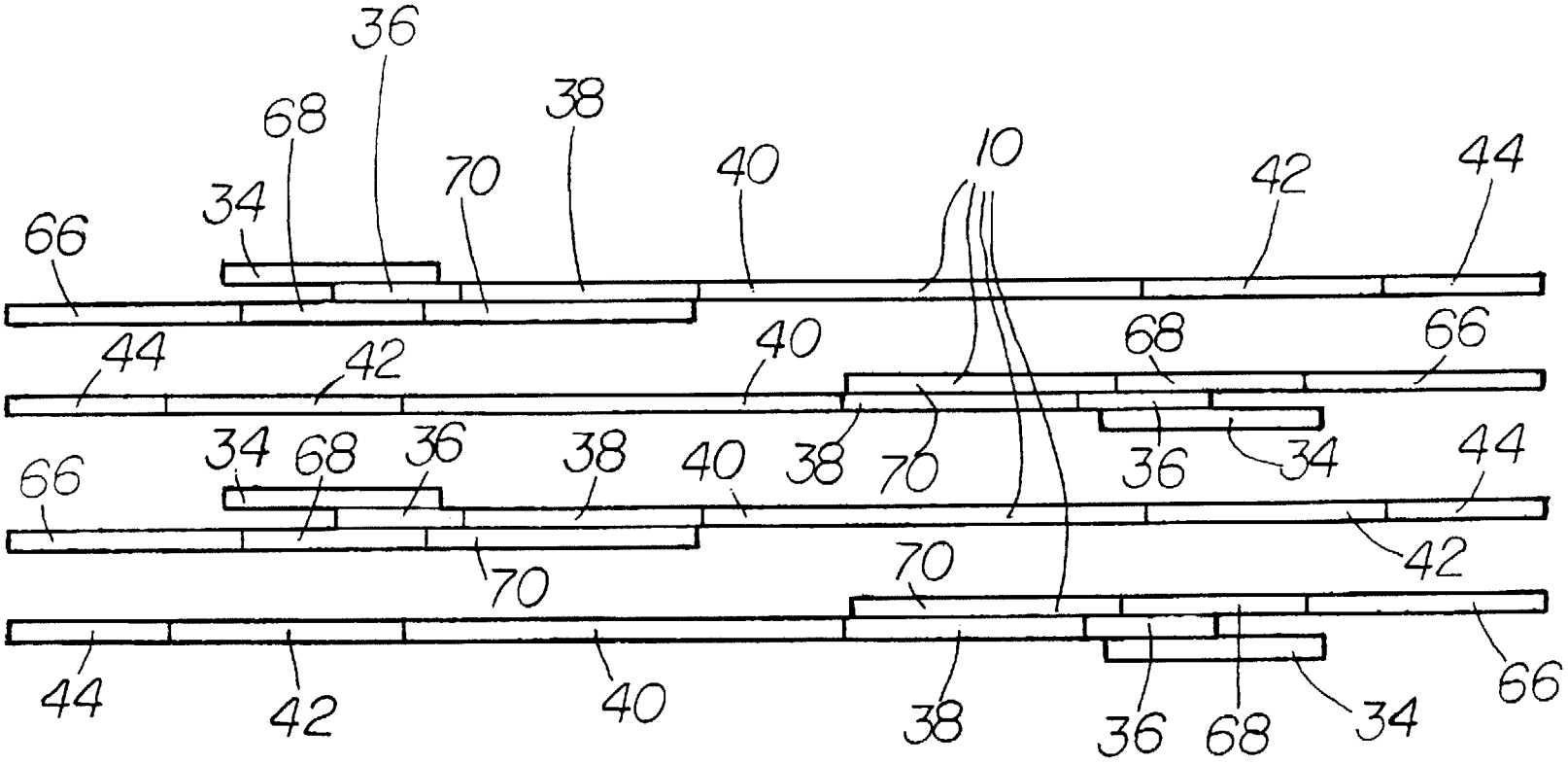
FIG. 15 is an end view of multiple spaced apart units of void forms of the invention in a packing configuration for shipping.

In the unassembled, i.e. "knocked-down" state, the void form 10 comprises a generally flat configuration, a large part of which is of one panel thickness. Using the packing pattern shown in FIG. 15, the number of void forms 10 of FIG. 2 which may be shipped in a given space is increased by a factor of about 6. This is true irrespective of whether the void form 10 is of embodiment 10A, 10B, 10C, 10D, or 10E. In this packing arrangement, alternate units of the void form 10 are reversed vertically and placed adjacent each other to minimize wasted space. The unassembled void forms are shown spaced apart for the sake of clarity. Thus, a major objective of the invention, i.e. a substantial savings in shipping costs, is readily achieved. Where the void form 10 is reinforced through the use of additional plies of corrugated paper, or thicker paper, or internal cellular structure, the shipping cost advantage may be somewhat less. Where the ratio of void form size to paper thickness is greater, the shipping cost advantage is enhanced.

As described, an advantage of the take-down void form 10 is that it may easily be made in a wide range of desired sizes, strengths and shapes to accommodate various construction requirements, merely by varying the panel widths and the locations of adhesive.

No adhesive 28 is required for assembling the collapsible void form 10 at the construction site. The void form 10 may be quickly and easily assembled with simple hand operation, merely by inserting the fifth panel 44 into the groove 128 between the panel 56 and tertiary sheet 34 (as in the embodiment 10A), or between panel 36 and tertiary sheet 34A, in the case of embodiment 10B. The void form 10 is easily cut to length with a saw or knife. Of course, there is no need to remove the void form 10 from its location below the poured concrete structure. The void form 10 disintegrates with time as it absorbs moisture, permitting the underlying soil 18 to expand without destructively forcing the concrete structure 12 upward.

While the use of the void form 10 is particularly described relative to the construction of a vertical concrete wall 12 or other structure in a trench 14, it is understood that the void form may also be used for other purposes, e.g. the pouring of a monolithic concrete floor structure having portions displaced by void forms to reduce structure weight.

Conventional forms may be used in conjunction with the void form 10 described herein, but such use is not generally recommended.

It is anticipated that various changes and modifications may be made in the construction, arrangement, operation and method of construction of the void forms disclosed herein without departing from the spirit and scope of the invention as defined in the following claims.

What is claimed is:

1. A collapsible void form for establishing a space in or adjacent to a concrete structure, comprising a substantially hollow structure having top, bottom, sides and interior support panels formed from sheets of planar corruguated paper material, said hollow structure comprising:

a first sheet comprising, a first panel forming a portion of the top;

a second panel joined to said first panel and comprising a first side portion;

a third panel joined to said second panel and comprising a base portion;

a fourth panel joined to said third panel and comprising a second side portion;

a fifth panel joined to said fourth panel;

a second sheet folded along parallel fold lines to form a center panel and two interior support panels extending from said top to said third panel, said center panel comprising a portion of said top;

a third sheet comprising a portion of said top;

wherein said first panel, center panel and third sheet are serially joined with adhesive to create an elongate groove to receive a portion of said fifth panel therein.

2. The collapsible void form of claim 1, wherein said first panel, center panel and third sheet include partially coextensive portions, said coextensive portions joined by adhesive.

3. The collapsible void form of claim 1, wherein said third sheet comprises an uppermost panel of said top.

4. The collapsible void form of claim 1, wherein said erected void form is substantially symmetrical about a central longitudinal vertical plane.

5. The collapsible void form of claim 1, wherein said first, second, third, fourth and fifth panels are formed from a sheet of paper by folding said sheet along four parallel fold lines.

6. The collapsible void form of claim 1, wherein said interior support panels of said second sheet are downwardly foldable to bear against the lines of juncture between the third panel and the panels joined thereto.

7. The collapsible void form of claim 1, wherein said side portions converge upwardly at angles of about 0–45 degrees from vertical.

8. The collapsible void form of claim 1, wherein said side portions converge upwardly at angles of about 0–25 degrees from vertical.

9. A collapsible void form for establishing a soil expansion space between a concrete structure and an underlying expansive soil during formation of said structure, said void form comprising:

a primary sheet of corrugated paper material with corrugation ribs in a first width direction, said primary sheet having a face surface and a reverse surface and configured to be folded along four parallel fold lines perpendicular to said first width direction to form a first, second, third, fourth and fifth panel in a row;

a secondary sheet of corrugated paper material with corrugation ribs in said first width direction, said secondary sheet having a face surface and a reverse surface and configured to be folded along two parallel fold lines perpendicular to said first direction to form a central panel, a left panel and a right panel in a row, the reverse surface of said central panel divided by an adhesive limit line, dividing the central panel into first and second portions, whereby the first portion of said central panel is joined by adhesive to the reverse surface of the first panel of said first sheet;

a tertiary sheet of corrugated paper material with corrugation ribs in said first width direction, said tertiary sheet having a face surface and a reverse surface, the reverse surface of said tertiary sheet divided by a second adhesive limit line dividing the tertiary sheet into first and second portions, whereby the first portion of said tertiary sheet is joined by adhesive to the face surface of said first panel of said primary sheet;

whereby a panel retaining space is formed between the second portions of the central panel and the tertiary sheet for receiving and retaining therein at least a portion of the fifth panel of said primary sheet.

10. The collapsible void of claim 9, wherein said left panel of said secondary sheet is downwardly foldable to form a brace between the fifth and third panels at said third fold line, and said right panel of said secondary sheet is downwardly foldable to form a brace between the first and third panels at said second fold line.

11. The collapsible void form of claim 9, wherein the combined widths of said first and fifth panels of said first sheet is less than the width of said third panel.

12. The collapsible void form of claim 9, wherein the combined widths of said first and fifth panels of said first sheet is equivalent to the width of said third panel.

13. The collapsible void form of claim 9, wherein the width of said central panel is less than the width of the combined first and fifth panels.

14. The collapsible void form of claim 9, wherein the respective widths of said second and fourth panels are equivalent and the assembled form void is symmetrical.

15. The collapsible void form of claim 9, wherein the respective widths of said second and fourth panels are unequal and the assembled form void is non-symmetrical.

16. A collapsible void form for establishing a space in or adjacent to a concrete structure, comprising:

a primary sheet of planar material comprising five panels separated by parallel fold lines, including first and second terminal panels, each said terminal panel having a free edge parallel to said fold lines, said first terminal panel having a first terminal surface portion and a second terminal surface portion, said terminal surface portions comprising portions of opposing surfaces of said one terminal panel and extending to the free edge thereof;

a secondary sheet of planar material comprising three panels including a center panel and two opposing interior support panels formed by folding said secondary sheet along two parallel fold lines, said center panel having first and second portions and where the first portion is joined by adhesive to said first terminal surface portion;

a tertiary sheet of planar material having first and second portions where the first portion thereof is joined by adhesive to the said second terminal surface portion of said first terminal panel;

whereby the second portion of said center panel and the second portion of said tertiary sheet are spaced apart and define a panel retaining space therebetween into which is received at least of portion of the second terminal panel, to form an assembled form void.

17. The collapsible void form of claim 16, wherein said planar corrugated paper has corrugation ridges in a first direction perpendicular to said parallel fold lines of said primary and secondary sheets.

18. The collapsible void form of claim 16, wherein said assembled form void includes abutting coplanar first and second terminal panels.

19. The collapsible void form of claim 16, wherein said interior support panels of said secondary sheet are downwardly foldable to bear against the lines of juncture between the third panel and the panels joined thereto.

20. A collapsible void form for establishing a space in or adjacent to a concrete structure, comprising:

a primary sheet of planar material comprising five panels separated by parallel fold lines, including first and second terminal panels, each said terminal panel having a free edge parallel to said fold lines, said first terminal panel having a first surface portion and a second surface portion, said first and second surface portions comprising the inside planar surface of the first terminal panel;

a tertiary sheet of planar material having inside and outside opposing surfaces and where the outside surface thereof is joined by adhesive to the second surface portion of the first terminal panel;

a secondary sheet of planar material comprising three panels including a center panel and two opposing interior support panels formed by folding said secondary sheet along two parallel fold lines, said center panel having first and second portions, said second portion being joined by adhesive to at least of portion of the inside surface of the tertiary sheet;

whereby the first portion of the center panel and the first terminal surface portion of the first panel are spaced apart to define a panel retaining space therebetween into which is received at least of portion of the second terminal panel, to form an assembled form void.

21. The collapsible void form of claim 20, wherein said planar corrugated paper has corrugation ridges in a first direction perpendicular to said parallel fold lines of said primary and secondary sheets.

22. The collapsible void form of claim 20, wherein said interior support panels extend from said center panel to said fold lines adjacent said third panel to enhance the strength of said void form.

* * * * *